United States Patent [19]

Chang

[11] Patent Number: 5,020,799

[45] Date of Patent: Jun. 4, 1991

[54] FOLDING BILLIARD TABLE

[76] Inventor: Yong-Hong Chang, No. 53-5, Fu Hsing Village Chi An Hsiang, Hwalien Hsien, Taiwan

[21] Appl. No.: 230,237

[22] Filed: Aug. 9, 1988

[51] Int. Cl.[5] ..... A63B 71/00

[52] U.S. Cl. ..... 273/3 C; 273/30; 108/115; 108/130; 108/131

[58] Field of Search ..... 273/3 R, 3 C, 30, 4 R, 273/4 C, 5 R; 108/129, 130, 133, 115, 64, 125, 127, 130, 131

[56] References Cited

U.S. PATENT DOCUMENTS

| | | | |
|---|---|---|---|
| 95,084 | 9/1869 | Clark | 273/5 R |
| 512,337 | 1/1894 | Standen | 273/5 R |
| 3,190,649 | 6/1965 | Heisler | 273/30 |
| 3,777,674 | 12/1973 | Parsons | 273/30 |
| 4,089,522 | 5/1978 | Rock | 273/30 |
| 4,762,321 | 8/1988 | Chang | 273/30 |

FOREIGN PATENT DOCUMENTS

| | | | |
|---|---|---|---|
| 744276 | 10/1966 | Canada | 273/4 R |

*Primary Examiner*—T. Brown

*Attorney, Agent, or Firm*—Brumbaugh, Graves, Donohue & Raymond

[57] ABSTRACT

A folding billiard table is provided with a pair of supports having legs and wheels thereon respectively for stability and easy handling purposes when the table is in correspondingly normal unfolded and folded configuration. A table formed of two symmetrical parts incorporating a center assembly thereunder to facilitate folding operation through a pair of gear racks. The center assembly is pivotally fixed to the underside of the two parts respectively at one end while the other end portion is further engaged with a pair of gears held in a fixed configuration in relation to said center assembly. A plurality of linking and reinforcing bars are provided to make the table a rigid assembly, and facilitate, the changing from normal unfolded to folded configuration or in reverse which is also effected by the operation of a spring, a tension block, and a locking mechanism disposed thereunder. Moreover, the space occupied by the table when in the folded configuration is obviously minimized.

6 Claims, 7 Drawing Sheets

FOLDING BILLIARD TABLE

BACKGROUND OF THE INVENTION

The present invention relates to a folding billiard table contrasting the conventional stationary one without folding means. The conventional and widely used billiard table is known to occupy a fairly large space and is inconvenient to transport or handle. Due to its heavy weight and rigidity requirement, a folding billiard table has never been invented before.

SUMMARY OF THE INVENTION

It is a primary object of the present invention to provide a billiard table with folding means therein to enable a folding operation after use so as to minimize the space occupied and to allow further easy handling.

A further object of the present invention is to provide a folding billiard table while maintaining its rigidity requirement.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENT

The whole assembly, in accordance with the present invention, comprises substantially a table 11 formed of two symmetrical parts 12, 13, a pair of supporting means 22 with a plurality of linking bars used as linking elements within the whole assembly, and a center assembly 44 below the table 11.

Figure 3:
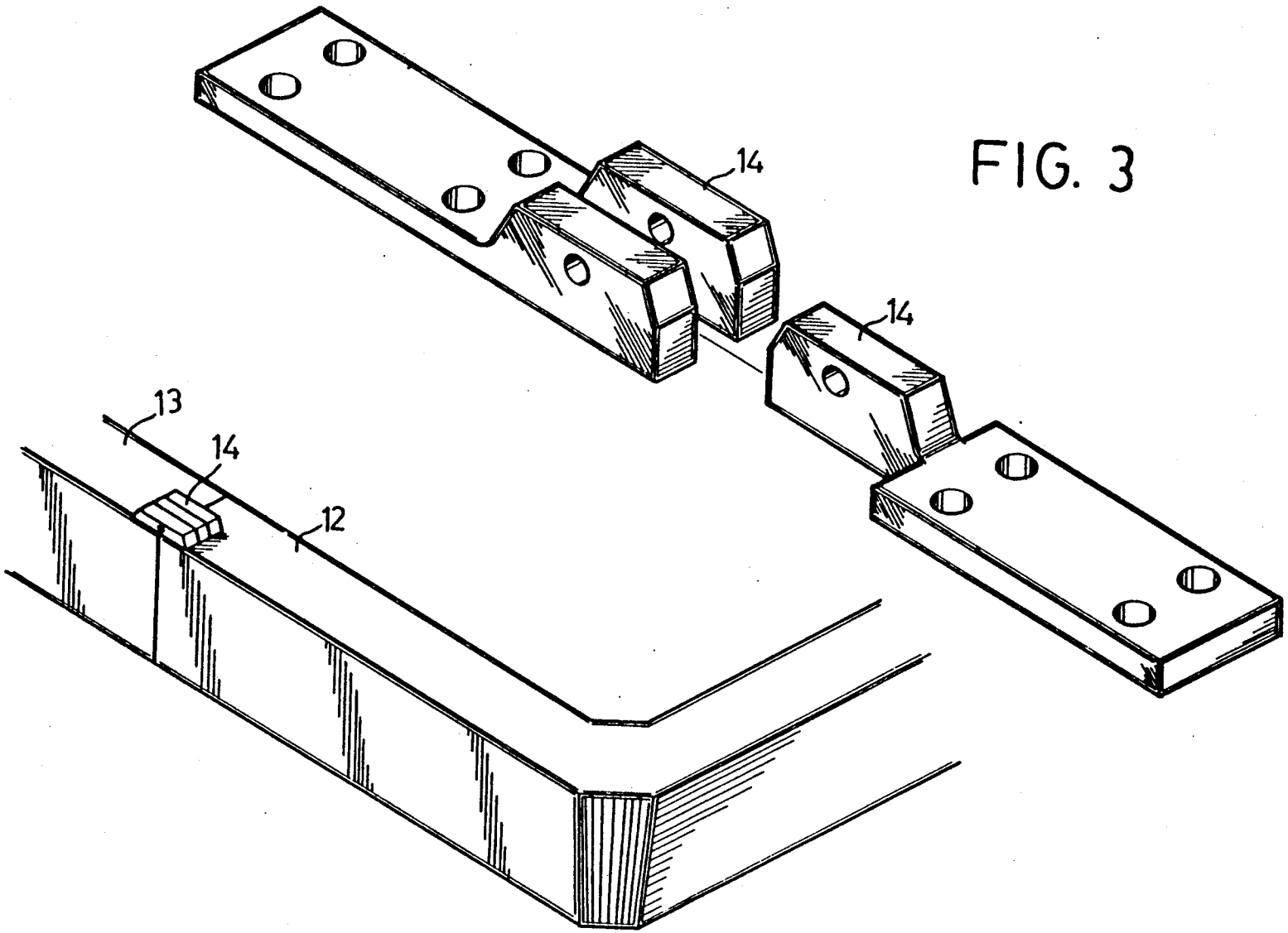
FIG. 3 shows a partial perspective view of FIG. 1 with a hinge in exploded view.

In the upper face of the periphery of the table 11 there are fitted a pair of hinges 14 on opposite sides, each formed of two complementary parts, as shown in FIG. 3, which serve as a connection between the two symmetrical parts 12, 13.

There are a pair of grooves 15 on the underside of each part 12, 13 near the center thereof, which are adapted to receive respectively a pivotally stationary bar 23 further connected to a vertical supporting leg 24 and a pivotally movable bar 25 further connected to a supporting wheel leg 26. Adjacent to each said groove 15 is a seating 16 secured to the underside of said table

11 with a seat hole 17 in the center of each seating 16. Each seat hole 17 is used to fit therein a corresponding positioning screw 27 located at each end of an upper horizontal supporting leg 28, when the whole assembly is in normal unfolded configuration.

Each supporting means 22 substantially comprises one said horizontal supporting 28 and two vertical supporting legs 24, joined in an inverted-U shape, a pair of said supporting wheel legs 26, a pair of aforementioned stationary and movable bars 23 and 25 respectively, and other reinforcing and connecting elements connected in the manner further described hereinbelow. There are generally three stationary reinforcing bars 29 disposed between said supporting legs 24, 28, 24, with one horizontal and two angled. An inwardly protruding bar 30 is also welded to said horizontal supporting leg 28 and slightly inclined toward the ground. Said vertical supporting leg 24 and said supporting wheel leg 26 are linked therebetween via a plurality of connecting plates 31 pivotally screwed thereon at two ends. The plane formed of said vertical supporting leg 24, said connecting plates 31, and said supporting wheel leg 26 is substantially normal to the general plane of said table 11.

Figure 1:
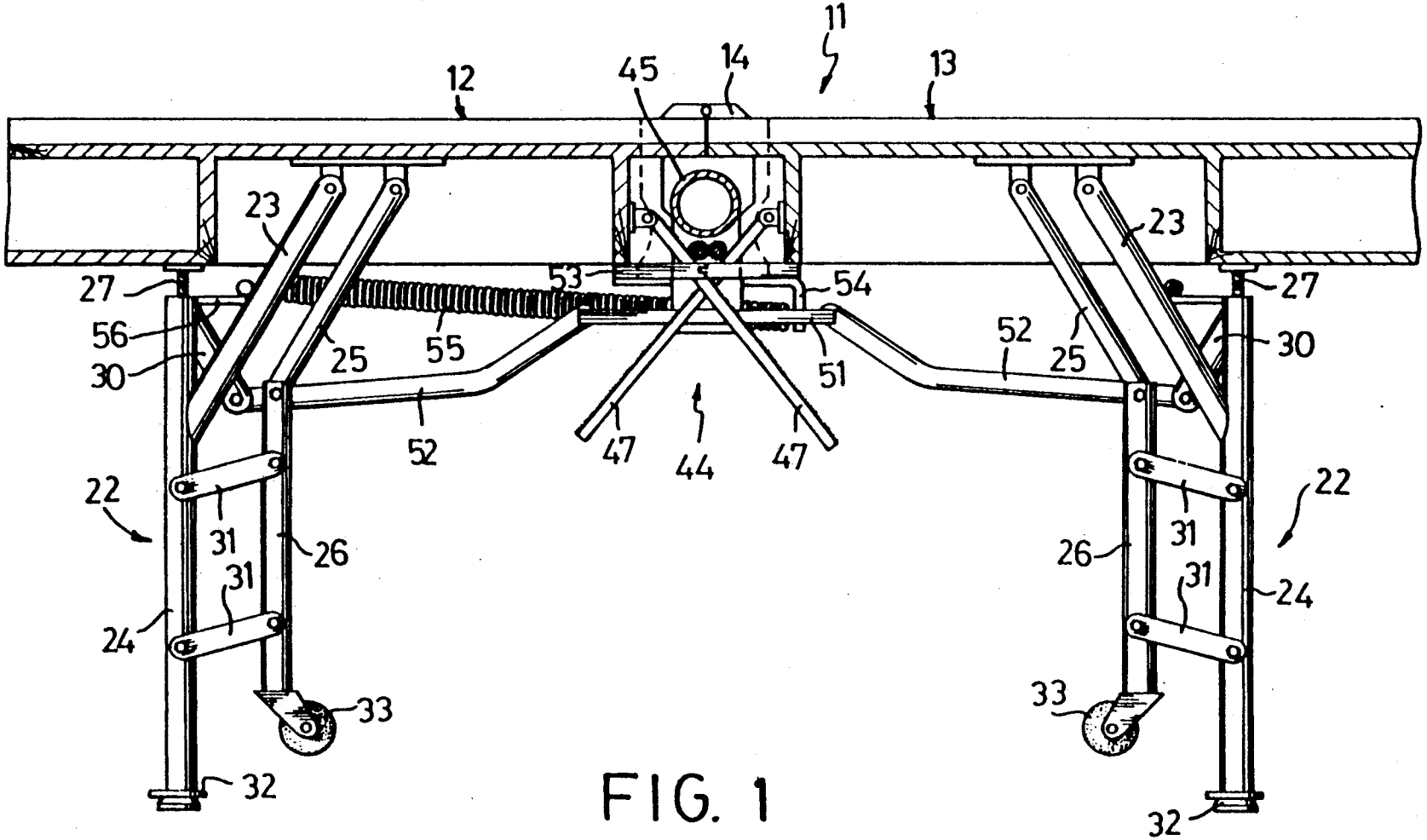
FIG. 1 is a cross-sectional view of a folding billiard table according to the present invention, when in the normal unfolded configuration.

When in normal unfolded configuration, as shown in FIG. 1, only said vertical supporting legs 24 will contact the ground with seat studs 32, while said supporting wheel legs 26 will accordingly lift up due primarily to the connecting plates 31.

Figure 2:
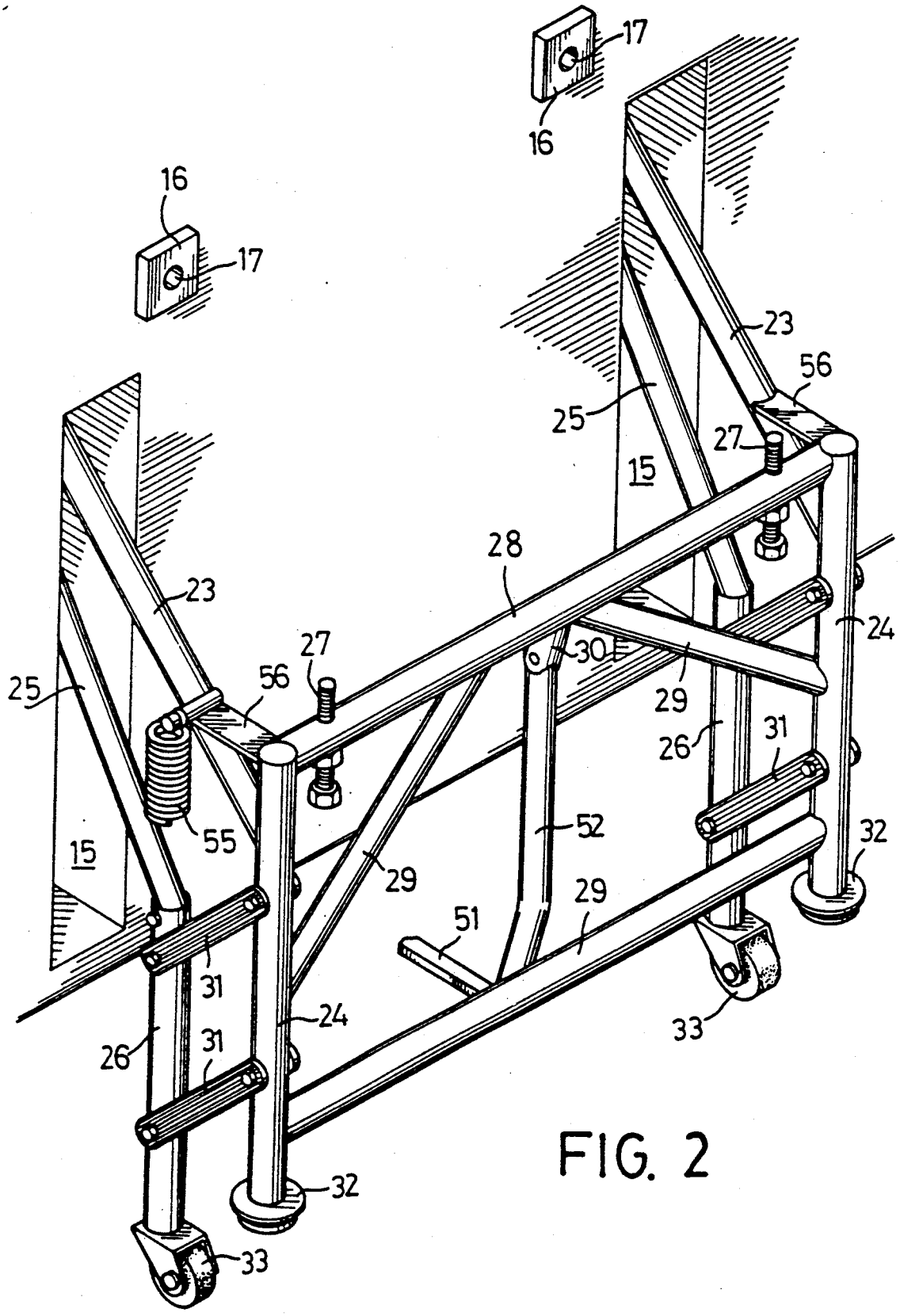
FIG. 2 is a fragmentary perspective view of the folding billiard table according to the present invention showing only a part of the table with the supporting means, when in the folded configuration.
Figure 7:
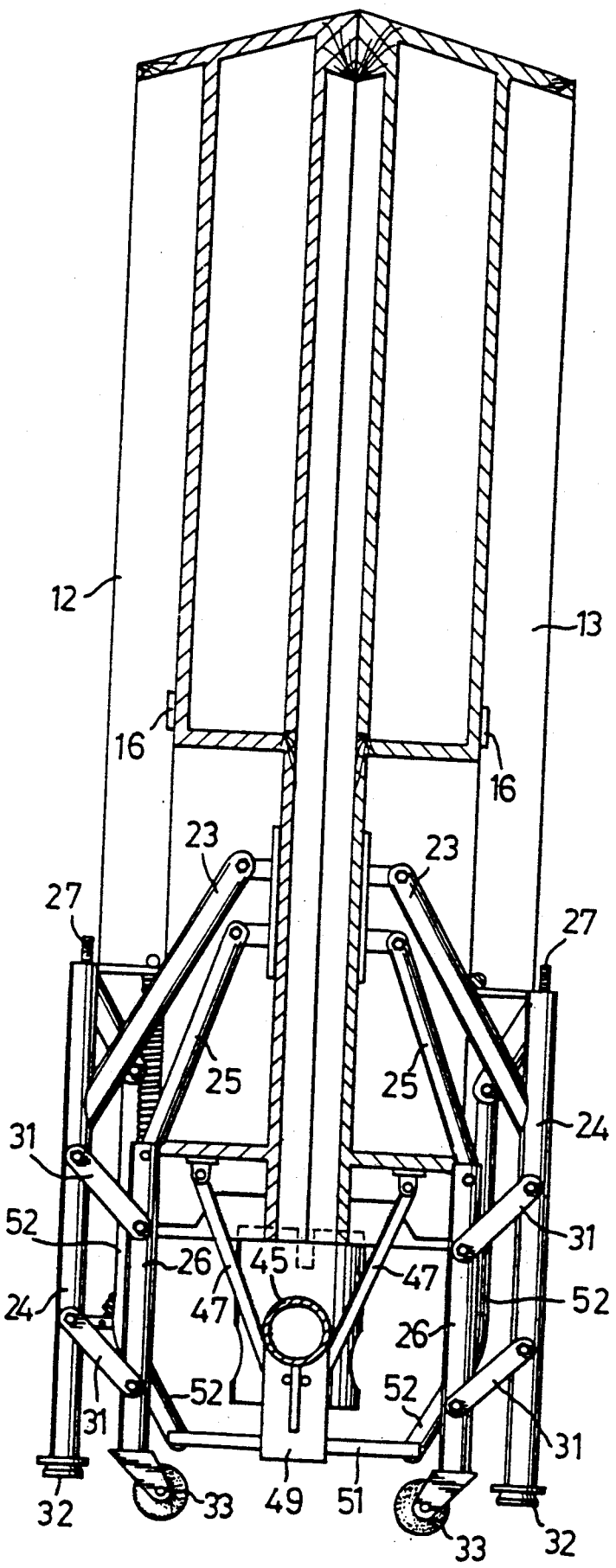
FIG. 7 is a cross-sectional view of the folding billiard table according to the present invention, when in the folded configuration.

When in the folded configuration, as shown in FIG. 2 and also in FIG. 7, the situation is similar to the above-mentioned normal unfolded configuration, but with said supporting wheel legs 26 instead contacting the ground with wheels 33 to make the whole assembly maneuverable for transporting or handling.

Figure 4:
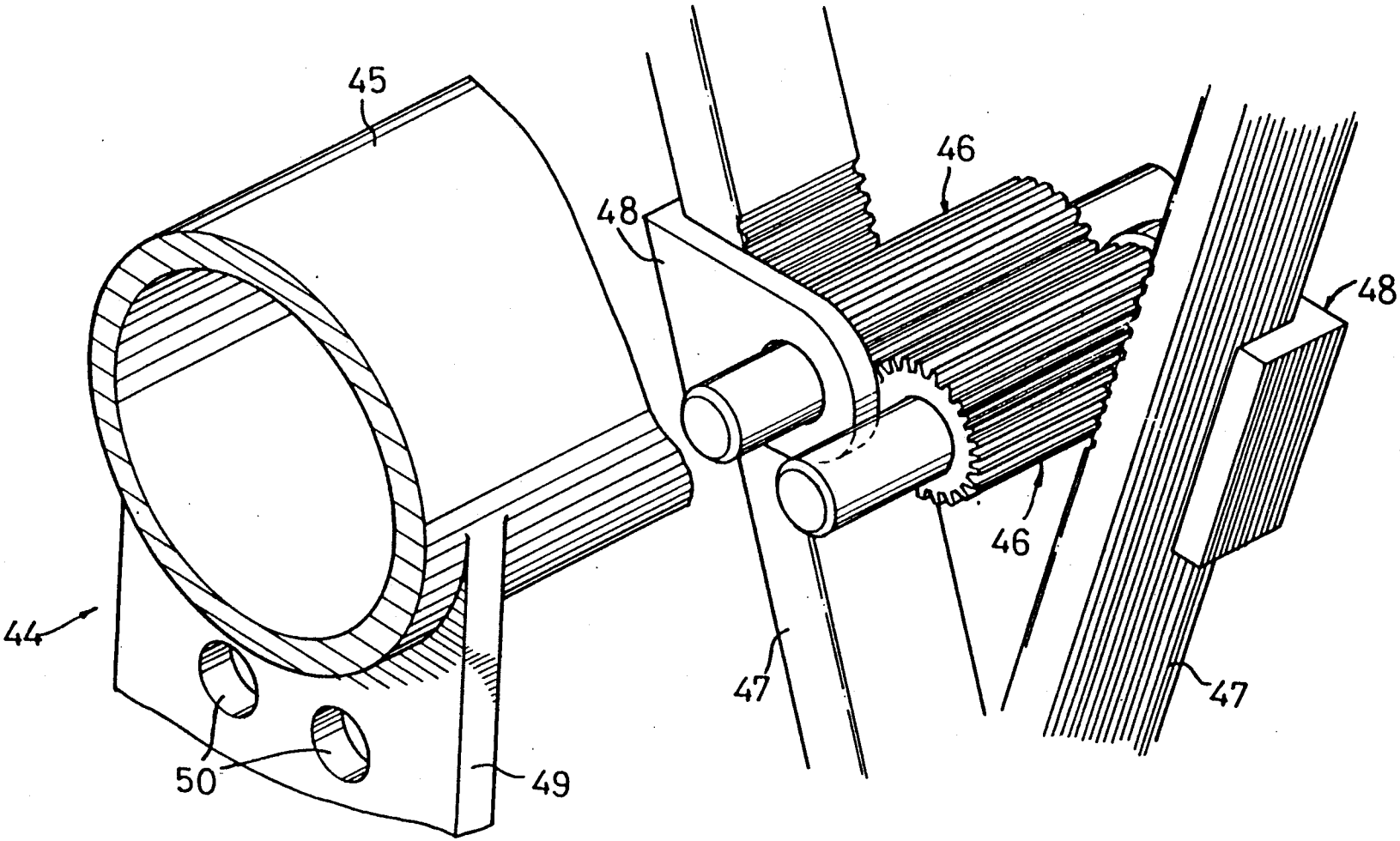
FIG. 4 illustrates a fragmentary perspective view of a portion of the center area of the folding billiard table according to the present invention.

Referring to FIG. 4, said center assembly 44 below the table 11 includes a center spindle 45 extending under the middle of the table 11, a pair of gears 46 engaged with each other, a pair of gear racks 47 askew relative to each other and both engaged with said gears 46 at an outer position thereof while the relative contacting relation is secured by a pair of angle brackets 48 as shown. Two positioning plate protrusions 49 having two holes 50, therethrough entered downward from said center spindle 45 disposed to hold said gears 46 and accordingly said gear racks 47 in position.

There is further a traverse bar 51, affixed to a plate protrusion 49, see FIG. 7, with each end pivotally connected to link a respective bar 52 which is each pivotally connected to said protruding bars 30, see FIG. 1. By this connection, the weight of the center assembly 44 is ascertained to be more evenly distributed over the supporting means 22.

Figure 5:
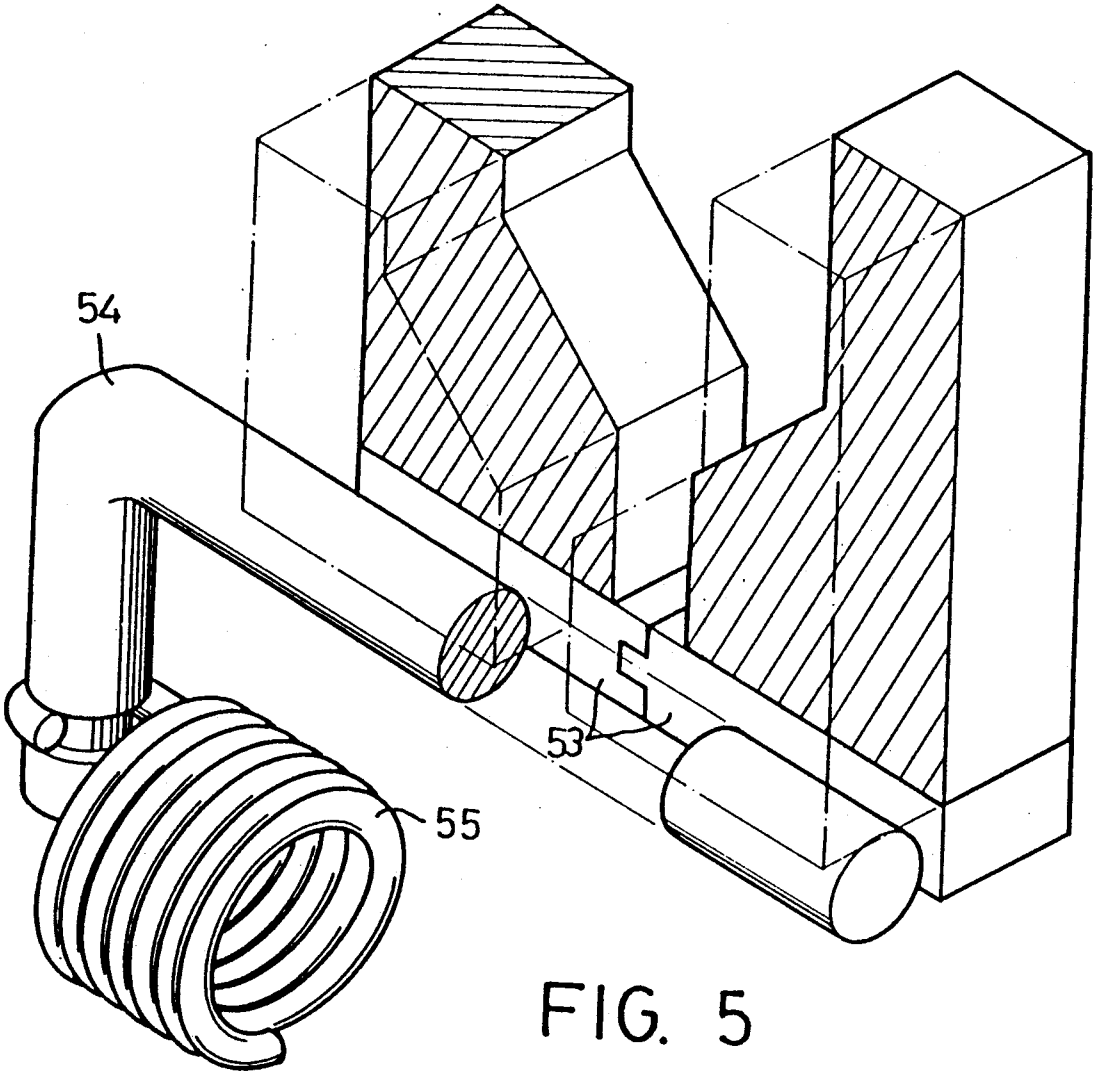
FIG. 5 gives a perspective view of the tension means of the folding billiard table according to the present invention.
Figure 6:
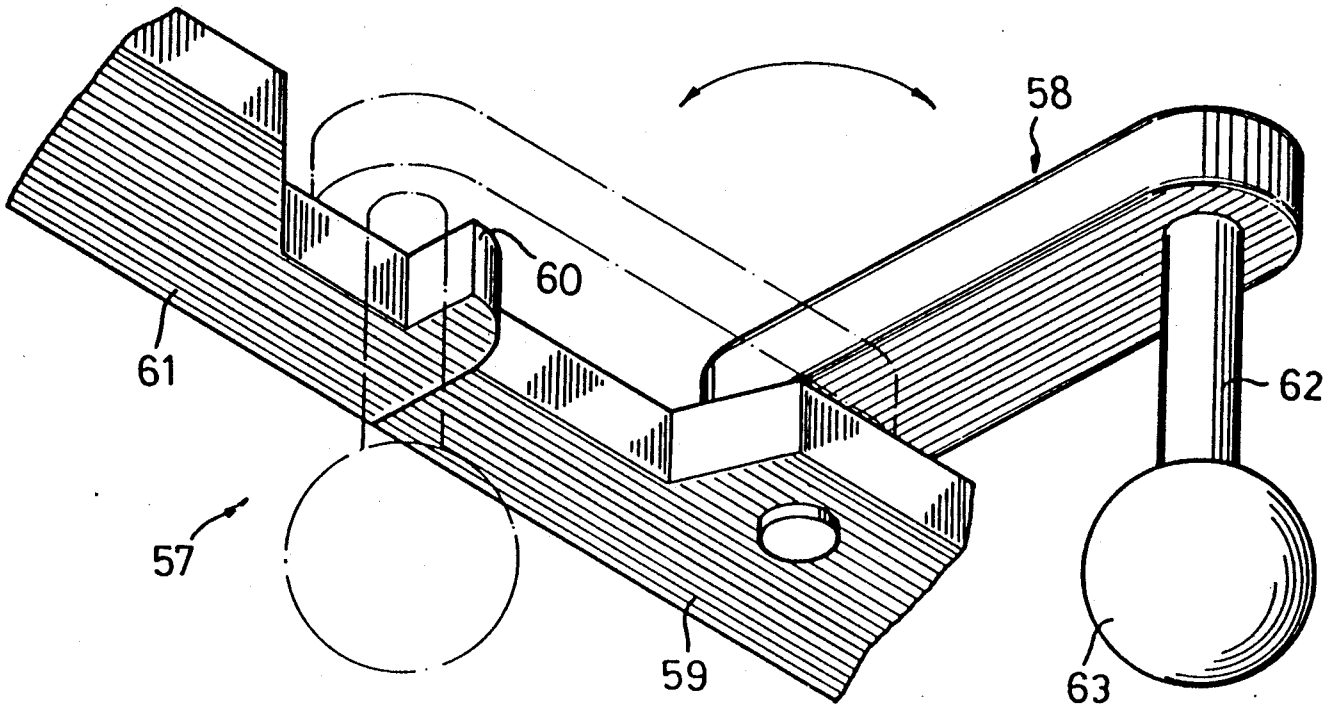
FIG. 6 gives a perspective view of the locking means according to the present invention.

On the underside of said table 11 is provided a tension block 53, as shown in FIG. 5, which is effected, when the table 11 is in the normal unfolded configuration, to stabilize the table 11 through its interconnection. Beside said tension block 53 is provided a spring holder 54 with one end connected to one end of a spring 55. Another end of the spring holder 54 is connected to a reinforcing plate 56 disposed between said stationary bar 23 and said vertical supporting leg 24. Also on the underside of the table 11 but on an opposite side of the center assembly 44 from said spring 55, there is disposed a locking mechanism 57 including a locking handle 58. When the table 11 is in the normal unfolded configuration, said locking handle 58, pivotally connected to a first stationary base 59, may be rotated to engage with a locking groove 60 formed on a secondary stationary base 61. Said first and second stationary base 59, 61 are, for example, made of steel blocks and fixedly attached to the table 11. As shown in FIG. 6, the locking handle 58 preferably includes a stick 62 with a ball end 63.

Referring again to FIG. 1 and FIG. 2, during opening the table 11 to the normal unfolded configuration, said gear racks 47, which are in essence pivotally engaged with said table 11 and held in engagement with said gears 46 by said angle brackets 48, are both ensured to slide or move the same amount in relation to said gears 46, which are in essence rotatable within said holes 50 of said plate protrusions 49, and accordingly may provide accurate configuration in accordance with this invention. Still during opening the table 11 to be the normal unfolded configuration, the upward movement of the center assembly 44 will naturally force said stationary bars 23 as well as said vertical supporting legs 24 to descend via the connecting plates 31 pivotally disposed between the vertical supporting leg 24 and the supporting wheel legs 26, until the ground is contacted by said seat stud 32. The subsequently accompanying ascending movement of the supporting wheel leg 26 is then readily apparent. Also the seat holes 17 in the seatings 16 are adapted to correctly receive the positioning screws 27.

Furthermore, the matching of said tension block 53, the engagement of said locking mechanism 57, and the spring force due to the spring 55 being stretched all aid in the accurate interconnection between components and the rigidity of this invention.

Referring now to FIG. 1 and FIG. 7, to fold the table 11, first unlock the locking mechanism 57 by rotating said locking handle 58, then slowly move down the center assembly 44 and/or push inward the supporting means 22 until said supporting wheel legs 26 eventually contact the ground, similar to the aforementioned situation, the following ascending movement of said vertical supporting leg 24 is again readily apparent. When in the folded configuration, shown best in FIG. 7, the smaller space occupied and the wheels 33 for easy transporting or handling are clearly shown advantages of this invention.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A foldable table comprising:

a table top formed in two halves, each half having opposite side edges, a top surface, and an underside having a pair of spaced apart grooves formed therein, each being disposed near and parallel to a respective side edge;

a pair of hinges mounted on said top surface near respective side edges of said two halves hinging the halves together for pivotal movement about a transversely extending axis between an operative configuration in which said two halves have mutually contacting edge and are disposed in a common horizontal plane and a folded configuration in which respective top surfaces of the two halves lie against and face one another in a vertical plane;

means including a pair of vertical support structures each including two supporting leg members and being pivotally connected to a respective table half within said grooves for movement toward each other when said halves are in said folded configuration and for movement away from each other when said halves are in said operative configuration at which said supporting leg members are vertically-oriented and support said table;

a pair of seats disposed on said underside of each half, each seat being positioned adjacent a respective said groove, for engaging a respective supporting structure when said table halves are in said operative configuration; and a table folding mechanism secured to both table halves on the underside thereof near said contacting edges, said mechanism including an elongate spindle having an axis extending transversely of said table and lying in a vertical plane which includes said hinging axis, and linking elements attached to said spindle separately operatively connecting said folding mechanism to said support structures.

2. A foldable table according to claim 1, wherein the supporting leg members of each support structure are rigidly connected at respective upper ends to a horizontally-oriented cross-bar said cross-bar having a length substantially equal to the spacing between said grooves and form a structure having the shape of an inverted-"U", and wherein said support structure further comprises:

each support structure having a pair of elongate stationary bars each rigidly connected at one end thereof to a respective supporting leg member at a point adjacent one end thereof and pivotally connected at its other end to the underside of a respective table half, each support structure having a pair of wheeled leg members, each having an upper end and a lower end to which a wheel is attached, first and second pairs of elongate connecting plates, each pair being pivotally connected at one end to respective supporting leg members and being pivotally connected at its other end to respective wheeled leg members, and a pair of elongate movable bars each pivotally connected at one end to the upper end of a respective wheeled leg member and pivotally connected at its other end to the underside of a respective table half for moving said wheeled legs to support said table in said operative and folded configuration.

3. A foldable table according to claim 1, wherein said table folding mechanism further comprises:

first and second positioning plates depending from said elongate spindle at spaced locations along the length thereof, each said plate having a pair of openings therethrough horizontally aligned with the openings in the other plate, first and second rotatable gears disposed between said first and second positioning plates each having shafts at both ends supported for rotation in respective aligned openings in said plates with said gears in meshing relationship, first and second elongate gear racks each having a first end pivotally connected to the underside of a respective table half at a location near said spindle for pivotal movement into positions where the gears of said first and second gear racks respectively engage said first and second rotatable gears, and bracket means for maintaining said gear racks and rotatable gears engaged in such a way that both gear racks are moved by equal amounts in response to rotation of said rotatable gears, and an elongate bar secured to one of said positioning plates and extending transversely of said spindle, said linking elements being pivotally connected between respective ends of said elongate bar and said support structures.

4. A foldable table according to claim 1, wherein said table further comprises a tension spring connected between one of said support structures and said table folding mechanism and dimensioned to be stretched when said table is in its operative configuration for stabilizing said table.

5. A folding billiard table comprising:

a table top formed in two halves having mutually contacting edges hinged together for pivotal movement about a transversely extending axis between an open operative configuration in which the two halves are disposed in a common horizontal plane and a folded configuration in which respective top surfaces of said two halves lie against and face one another in a vertical plane, each table half having opposite side edges and an underside having a pair of spaced grooves formed therein near and parallel to respective side edges thereof;

means including a pair of vertical support structures each including two supporting leg members rigidly connected at an upper end thereof to a horizontally-oriented cross-bar having a length substantially equal to said spacing between said grooves;

a pair of elongate stationary bars each rigidly connected at one end thereof to a respective supporting leg member at a point adjacent one end thereof and pivotally connected at its other end to said underside of a respective table half;

said support structure further include a pair of wheeled leg members, each having an upper end and a lower end to which a wheel is attached, and first and second pairs of elongate connecting plates, each pair of connecting plates being pivotally connected at one end to respective supporting leg members and pivotally connected at the other end to respective wheeled leg members;

a pair of elongate movable bars each pivotally connected at one end to said upper end of a respective wheeled leg member and pivotally connected at its other end to the underside of a respective table half for moving said wheeled legs into positions to support said table when the table is in its folded configuration;

table folding means secured to said underside of both table halves near their mutually contacting edges, said table folding means including an elongate spindle having an axis extending transversely of said table and disposed in a vertical plane which includes the hinge axis, first and second spaced positioning plates depending from said spindle, each having a pair of openings therethrough horizontally aligned with the openings in the other plate, first and second rotatable gears disposed between and journalled at both ends in respective aligned openings in said plates in meshing relationship, first and second elongated gear racks each having a first end pivotally connected to said underside of a respective table half at a location near said spindle for pivotal movemet into meshing engagement with said first and second rotatable gears, respectively, and bracket means for maintaining said gear racks in engagement with said rotatable gears whereby both gear racks are moved by equal amounts in response to rotation of said rotatable gears, and an elongate bar secured to one of said positioning plates and extending transversely of said spindle, and a pair of linking elements respectively pivotally connected between an end of said elongate bar and a respective support structure; and a tension spring connected between one of said support structures and said table folding means dimensioned to be stretched when said table is in its operative configuration for stabilizing said the table.

6. A folding billiard table according to claim 5, wherein said table further comprises:

a pair of seats disposed on the underside of each table half adjacent a respective groove for engaging portions of the horizontally-oriented cross-bar of a respective supporting structure when the table halves are in said operative configuration.

* * * * *